US005537892A

United States Patent [19]

Wiechman

[11] Patent Number: 5,537,892

[45] Date of Patent: Jul. 23, 1996

[54] CONTROL LEVER ASSEMBLY AND MOUNTING APPARATUS

[75] Inventor: Dean A. Wiechman, Plano, Ill.

[73] Assignee: Caterpillar Inc., Peoria, Ill.

[21] Appl. No.: 188,853

[22] Filed: Jan. 31, 1994

[51] Int. Cl.[6] ..... G05G 5/05

[52] U.S. Cl. ..... 74/527; 74/475; 74/531

[58] Field of Search ..... 74/475, 527, 531; 267/150

[56] References Cited

U.S. PATENT DOCUMENTS

| | | | |
|---|---|---|---|
| 2,323,859 | 7/1943 | Wheatley | 74/491 |
| 2,401,741 | 3/1943 | Korodi et al. | 74/531 |
| 2,955,483 | 10/1960 | Slomer | 74/527 |
| 3,181,390 | 5/1965 | Juy | 74/531 |
| 3,315,959 | 4/1967 | Carnielli | 74/531 |
| 3,858,012 | 12/1974 | Lockard | 200/16 D |
| 3,871,244 | 3/1975 | Gressard et al. | 74/491 |
| 3,921,955 | 11/1975 | Haddad, Jr. | 74/531 |
| 3,943,792 | 3/1976 | Sibeud | 74/473 R |
| 3,972,249 | 8/1976 | Hansen | 74/526 |
| 4,074,100 | 2/1978 | Hults et al. | 200/339 |
| 4,081,643 | 3/1978 | Kuo | 200/153 G |
| 4,132,128 | 1/1979 | Roggenkamp | 74/527 |
| 4,222,474 | 9/1980 | Choudhury | 192/0.096 |
| 4,245,137 | 1/1981 | Hirai et al. | 200/4 |
| 4,267,744 | 5/1981 | Yamasaki | 74/489 |
| 4,452,098 | 5/1984 | Wallace et al. | 74/531 |
| 4,567,786 | 2/1986 | Sakurai | 74/483 R |
| 4,575,592 | 3/1986 | Rose | 200/6 R |
| 4,622,861 | 11/1986 | Hill | 74/531 |
| 4,949,591 | 8/1990 | Roelle | 74/531 |
| 5,052,883 | 10/1991 | Morita et al. | 414/700 |
| 5,189,924 | 3/1943 | Altenheiner et al. | 74/473 R |
| 5,261,290 | 11/1993 | Ramsay et al. | 74/475 |
| 5,377,555 | 1/1995 | Hancock | 74/527 |

FOREIGN PATENT DOCUMENTS

| | | | |
|---|---|---|---|
| 3432736 | 9/1984 | Germany | G05G 5/16 |
| 3319417 | 12/1984 | Germany | G05G 7/10 |

*Primary Examiner*—Charles A. Marmor
*Assistant Examiner*—David Fenstermacher
*Attorney, Agent, or Firm*—William C. Perry

[57] ABSTRACT

In the mounting of a control lever utilized to manipulate a machine or implements of a machine, complex designs are often required to provide lever positioning stops and operational detents. The mounting apparatus of the present invention provides a control lever that is mounted within a housing by a plurality of non-metallic bearing members. At least one side portion of the bearing member bears against the control lever. Integrally formed in this side portion is a mounting apparatus for maintaining the position of the control handle in a preselected position. In addition, a recess is integrally formed in the bearing member for resisting the movement of the control lever and indicates when the control lever is approaching a point at which a functional change in the implement, controlled by the control lever, is about to occur.

18 Claims, 4 Drawing Sheets

CONTROL LEVER ASSEMBLY AND MOUNTING APPARATUS

TECHNICAL FIELD

This invention relates to the mounting of a control lever and more particularly to a mounting arrangement that includes a lever centering mechanism and detent indicators.

BACKGROUND ART

In the operation of modern day construction equipment, reduction of the effort required by the operator to manipulate the various machine implements has been a long standing goal. One known method to accomplish this goal is to replace the normally hydraulically actuated controls with electronic controls. With this change, the amount of effort required by the operator to manipulate the controls is reduced substantially since the operator no longer has to move his controls through extensive linkage mechanisms that ultimately operate against the hydraulic flow forces that exists within the control system. With the reduction in force required to manipulate the controls, a reduction in the size of the components has also been realized. This in turn, allows a change in material from which the components are manufactured. In many instances, the use of non-metallic material has replaced much heavier, more expensive components made from metal. Even with these advancements, the control mechanisms often require additional components to position the control levers and to provide operational detents therefore. These additional components invariably add to the complexity and therefore the cost of the design.

The present invention is directed to overcoming one or more of the problems as set forth above.

DISCLOSURE OF THE INVENTION

In one aspect of the present invention a control lever assembly and mounting apparatus is provided. The mounting apparatus includes a housing and a control lever positioned within the housing. First and second bearing members, each having a first side portion, are positioned on opposite sides of the control lever from one another with the respective first side portions thereof in engagement with the control lever to allow limited movement of the control lever with respect to the housing. In addition, a means for positioning the control lever at a preselected position is provided that is integrally defined by at least one of the first side portions defined by the first and second bearing members. Finally, a means for resisting movement of the control lever is included that is also integrally defined by at least one of the first side portions defined by the first and second bearing members.

In another aspect of the invention a control lever assembly and mounting apparatus lever is provided that includes a housing and first and second control levers. Each of the first and second control levers has a first generally cylindrical end portion and first and second pivot shafts that extend from opposing sides of the control levers along a substantially horizontal axis. Each of the control levers is positioned with the first end portion extending from the housing for movement with respect to said housing in a first and second direction. Four individual bearing members are provided, each having first and second side portions and a generally centrally disposed bore extending therethrough. The first bearing member is positioned with the first side portion thereof engaged with the first control lever and the second side portion thereof engaged with the housing. The second bearing member is positioned with the first side portion thereof engaged with the first control lever. The first and second pivot shafts of the first control lever are positioned within the centrally disposed bores of the respective first and second bearing members. The third bearing member is positioned with the first side portion engaged with the second control lever, while the fourth bearing member is positioned with the first side portion thereof engaged with the second control lever and the second side portion thereof engaged with the housing. The first and second pivot shafts of the second control lever are positioned within the centrally disposed bores of the respective third and fourth bearing members. A means for positioning the respective control levers at a preselected position is included that is integrally defined by at least one of the first side portions defined by the bearing members engaged with the respective control levers. Finally, a means for resisting movement of the respective control levers is provided that is also integrally defined by at least one of the first side portions defined by the bearing members engaged with the respective control levers.

With a control lever assembly and mounting apparatus as set forth above, one or a plurality of control levers may be mounted in a very compact space since the positioning and movement resisting means are integrally formed by the bearing members themselves. In addition, the integral formation of the positioning and movement resisting means within the bearing members reduces the number of components that have been required in the past and therefor provides substantial economical advantages.

BEST MODE FOR CARRYING OUT THE INVENTION

Figure 1:
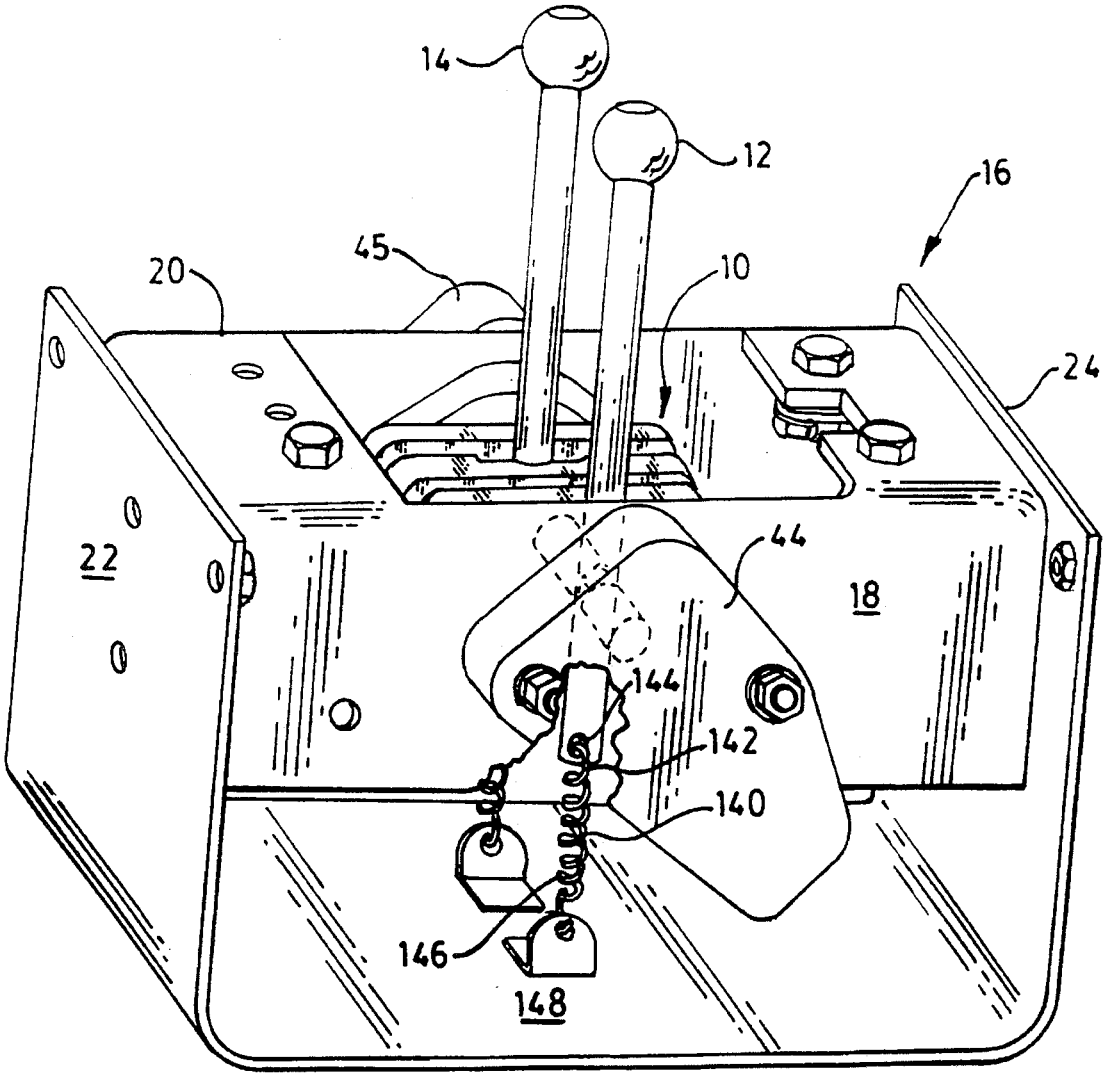
FIG. 1 is a diagrammatic, partially sectioned side view of a control console that has a pair of control levers mounted in accordance with the principles of the present invention.

Referring to the drawings, it can be seen that a mounting apparatus 10 for a first and second control lever 12 and 14 is provided. The control levers 12 and 14 are mounted within a housing 16 that includes a pair of opposing sidewalls 18 and 20 that are positioned between a pair of endwalls 22 and 24. A pair of mounting shafts 26 and 28 extend between and are secured to the respective sidewalls 20 and 22 and are maintained is spaced, parallel relationship to one another.

The control levers 12 and 14 are essentially identical to one another and are positioned side-by-side within the housing 16 between the pivot shafts 26 and 28. Each control lever defines a first cylindrical end portion 30 and 32 respectively, that extends vertically from the housing 16 and defines a control knob or other formation that would provide a grasping portion that may be engaged by a machine operator to aid him in the manipulation of the control lever. The first end portion 30 of the control lever 12 extends from a second end portion 34 that is positioned within the housing in a manner to be described in greater detail hereinafter. The second end portion defines a pair of pivot shafts 36 and 38 that extend from opposite sides of the control lever 12 and are centered along a generally horizontal axis 40 for rotation thereabout. Likewise, control lever 14 has a second end portion 41 that defines pair of pivot shafts 42 and 43 that extend from opposite sides thereof and are also positioned for rotation about the axis 40. Pivot shafts 36 and 43 extend through the respective sidewalls 18 and 20 and engage an electronic control means 44 and 45 that are attached to the respective sidewalls 18 and 20 of the housing 16.

The control levers 12 and 14 are mounted for movement in a plane that extends parallel to the sidewalls 18 and 20 of the housing 16. The movement of the control levers is aided by four non-metallic bearing members 46, 48, 50, 52. The first and second bearing members 46 and 48 are positioned on opposing sides of control lever 12 while the third and fourth bearing members 50 and 52 are positioned on opposing sides of control lever 14.

The first bearing member 46 defines a first, generally planar side portion 54 that bears against the cylindrical portion 30 of the control lever 12 and a second, generally planar side portion 56 that bears against the sidewall 18. The first bearing member has a first end portion 58 that defines a first mounting bore 60 that is sufficient for receiving the mounting shaft 26 therewithin. Likewise, a second end portion 62 defines a second mounting bore 64 that is sufficient for receiving the mounting shaft 28. A third, generally centrally disposed mounting bore 66 is defined in the first bearing member and is sufficient for receiving the pivot shaft 36 defined by the control lever 12.

The second bearing member 48 defines a first side portion 68 that bears against the cylindrical portion 30 of the control lever 12 and a second generally planar side portion 70 that is defined on the opposite side of the second bearing member from the first side portion. The second bearing member 48 has a first end portion 72 that defines a first mounting bore 74 and a second end portion 76 that defines a second mounting bore 78. The mounting bores 76 and 78 are of sufficient size to receive the mounting shafts 26 and 28 respectively in a manner that will allow the second bearing member to slide axially along the mounting shafts. A third, generally centrally disposed mounting bore 80 is positioned between the first and second mounting bores 74 and 78 and is sufficient to receive the pivot shaft 38 of the control lever 12.

The third bearing member 50 defines a first side portion 82 that bears against the cylindrical portion 32 of the control lever 14 and a second generally planar side portion 84 that is defined on the opposite side of the third bearing member from the first side portion. The third bearing member has a first end portion 86 that defines a first mounting bore 88 and a second end portion 90 that defines a second mounting bore 92. The first and second mounting bores 88 and 92 are of sufficient size to receive the mounting shafts 26 and 28 respectively, therewithin in a manner to allow the third bearing member to slide axially along the mounting shafts. A third mounting bore 94 is generally centrally disposed between the first and second mounting bores 88 and 92 and is sufficient to receive the pivot shaft 42 defined by the control lever 14.

The fourth bearing member 52 defines a first side portion 96 that bears against the cylindrical portion 32 of the control lever 14 and a second, generally planar side portion 98 that bears against the sidewall 20. The fourth bearing member has a first end portion 100 that defines a first mounting bore 102 and a second end portion 104 that defines a second mounting bore 106. The first and second mounting bores 102 and 106 are sufficient for receiving the mounting shafts 26 and 28 respectively. A third mounting bore 108 is generally centrally disposed between the first and second mounting bores 102 and 106 and is sufficient for receiving the pivot shaft 43 defined by control lever 14.

Figure 4:
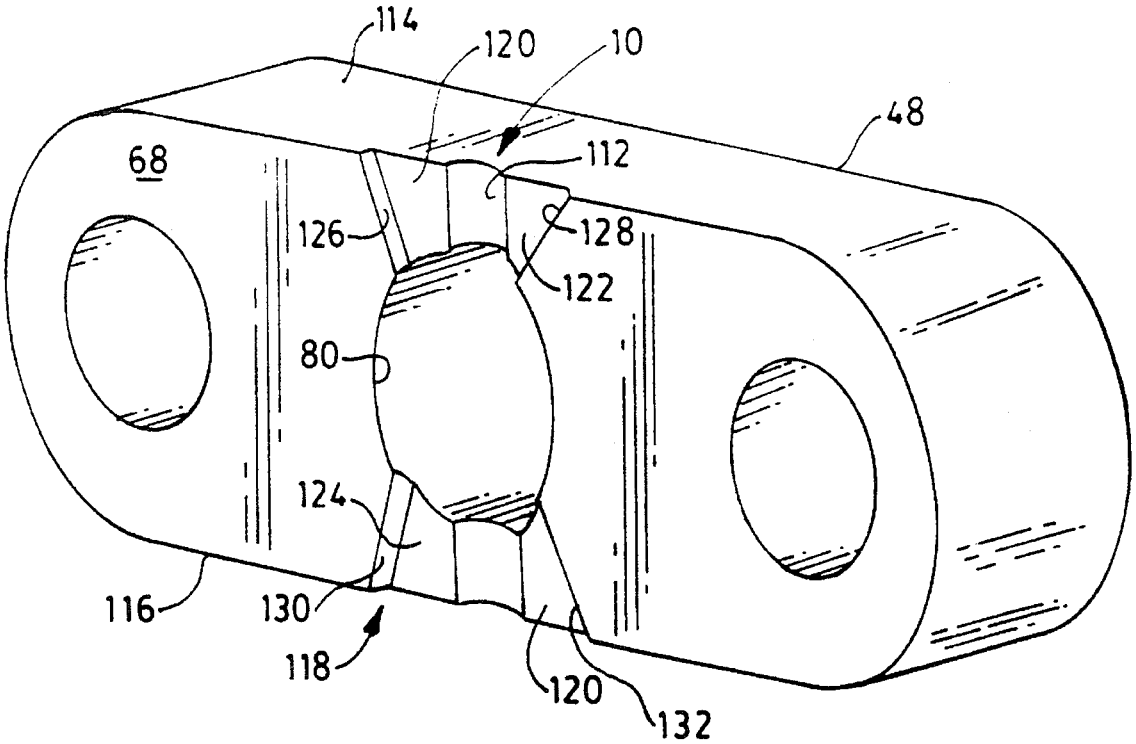
FIG. 4 is a diagrammatic perspective view of one of the bearing members utilized in the mounting of the control levers.

Referring to FIG. 4, a means 110 for positioning the control lever 12 is illustrated in association with the second bearing member 48. Since the second and third bearing members are essentially identical except for the direction in which their respective first side portions 68 and 82 face, identical reference numerals will be used to describe those elements that are common to both bearing members. The positioning means 110 is integrally formed in the first side portion 68 of the bearing member and includes a generally vertical groove 112 that extends between an upper surface 114 and a lower surface 116 defined by the bearing member. The groove 112 intersects the third mounting bore 80 and defines an arcuate depression in the first surface of the bearing member that is sufficient for nesting engagement with the cylindrical portion 30 of the control lever 12.

A means 118 for resisting the movement of the control levers 12 and 14 is also integrally formed in the first side portions 68 and 82 of the second and third bearing members 48 and 50. As can be seen with reference to FIG. 4, the movement resisting means 118 includes a recess 120 that is positioned on opposite sides of the groove 112 and also extends between the third mounting bore 80 and the respective upper and lower surfaces 114 and 116 to divide the recess into a first or upper portion 122 and a second or lower recess portion 124. The upper recess portion 122 defines first and second shoulders 126 and 128 that extend between the third mounting bore 80 and the upper surface 114. The shoulders are positioned at an angle to one another and diverge from each other as they extend toward the upper surface from the mounting bore. Likewise, the lower recess portion 124 defines third and fourth shoulders 130 and 132 that extend between the third mounting bore 80 and the lower surface 116 at a diverging angle to one another. Being so positioned, the first and fourth shoulders 126 and 132 are aligned with one another between the upper and lower surfaces 114 and 116 while the second and third shoulders 128 and 130 are aligned with one another in the same fashion to form a generally "X" shaped configuration in the first surface 68 of the bearing member.

Figure 2:
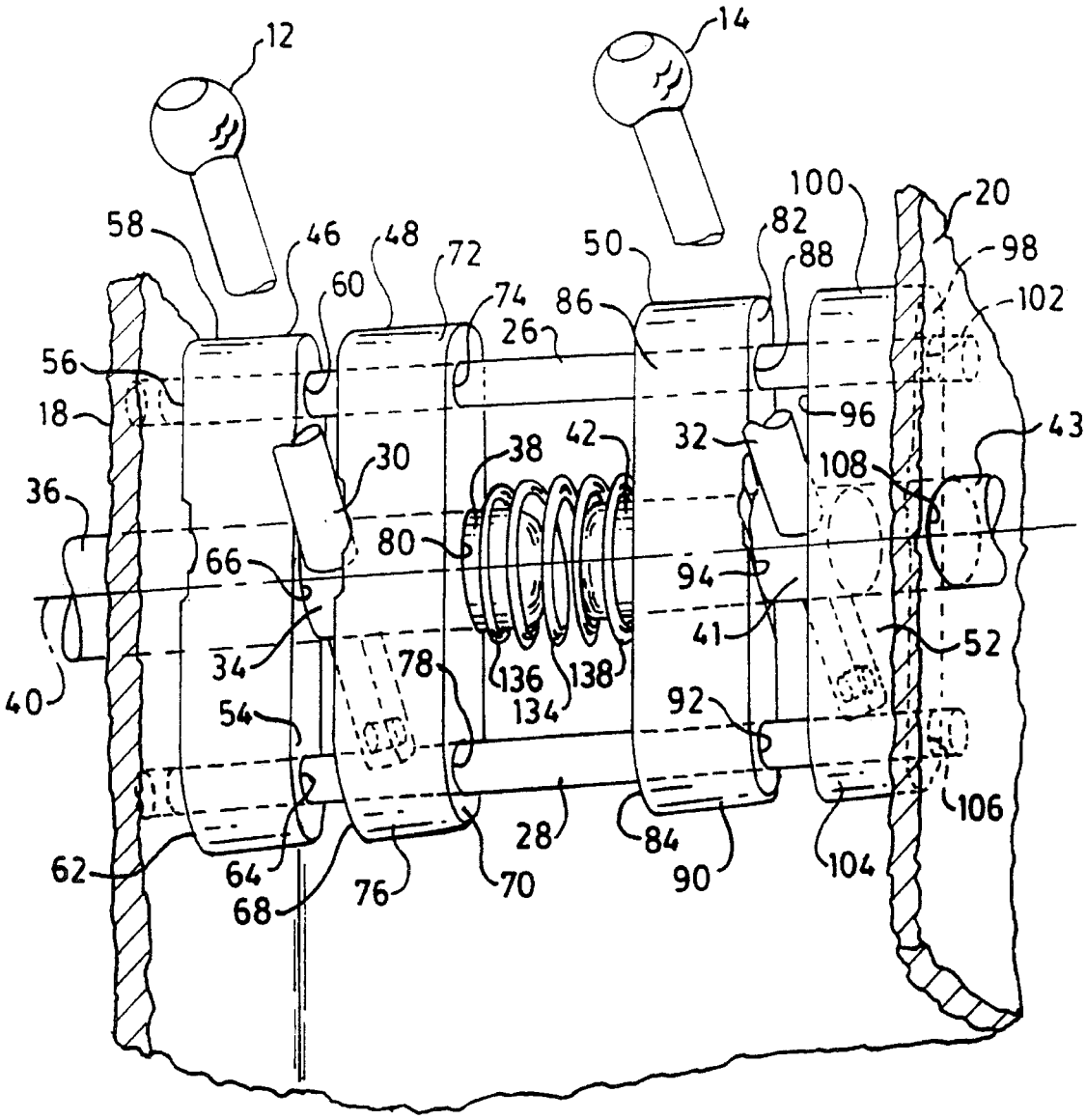
FIG. 2 is a diagrammatic perspective view of the control levers disclosed in FIG. 1 viewed from a location that is above and rearward of the control console disclosed in FIG. 1.
Figure 3:
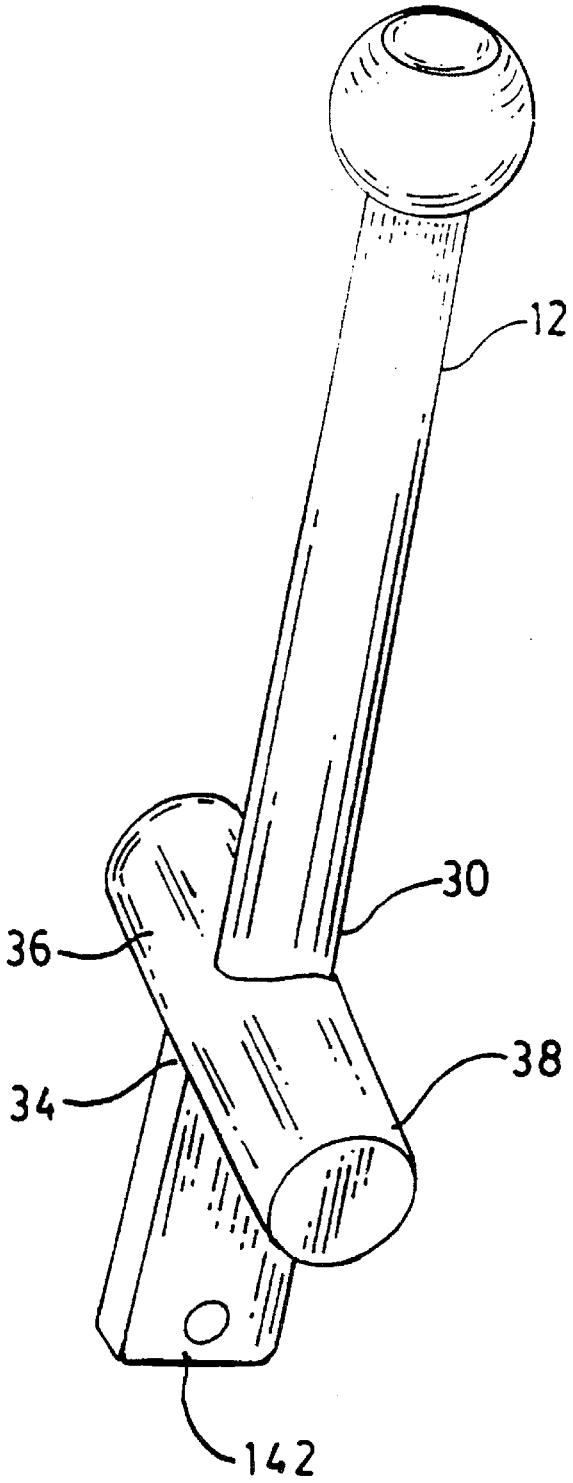
FIG. 3 is a diagrammatic perspective view of one of the control levers.

A first spring member 134, best shown in FIG. 2, is positioned between the second and third bearing members 48 and 50 respectively in a manner wherein a first end portion 136 of the spring bears against the second bearing member 48 and a second end portion 138 bears against the third bearing member 50. The spring member 134 is positioned about the respective pivot shafts 38 and 42 that have sufficient length to extend entirely through the respective bearing members 48 and 50, beyond their respective second side portions 70 and 84 to serve as a pilot for the spring 134. Being so positioned, the spring member 134 urges the respective first side portions 68 and 82 of the second and third bearing members into engagement with the respective cylindrical portions 30 and 32 of the control levers 12 and 14.

A second spring member 140 (FIG. 1) has a first end portion 142 connected to an aperture 144 formed in the second end portions 34 and 41 of the control levers 12 and 14 respectively, and a second end portion 146 that is connected to a base portion 148 of the housing. Being so positioned, the second spring member 140 provides an assist to urge the control lever to assume a generally vertical position when released by the operator.

While the positioning means 110 and movement resisting means 118 are shown and described in conjunction with bearing members 48 and 50, it is to be understood that these element could be formed in all the bearing members to make them identical and thereby simplify the manufacturing process. The individual bearing members may be selectively turned around to position the first side portions to bear against either of the control levers or housing sidewalls.

Industrial Applicability

In operation, the control levers 12 and 14 may be moved in a plane that is parallel to the sidewalls 18 and 20 of the housing 16 in either of a first or second direction from a generally vertical, neutral position. With respect to control lever 12, it can be seen that in the neutral or vertical position, the cylindrical portion 30 is nested within the groove 112 defined by the positioning means 110 defined in the first side portion 68 of the second bearing member 48. This nesting relationship tends to maintain the control lever in its vertical orientation in absence of a force in either of the first or second directions. Referring specifically to FIG. 2, when the lever is moved in the first or forward direction, the movement of the lever will be parallel to the first side portions 54 and 68 of the respective bearing members 46 and 48 between which the control lever is sandwiched. As it moves, the control lever will rotate about the horizontal axis 40 and will move out of the groove 112, causing the second bearing member 48 to move toward the third bearing member 52 against the bias of the first spring 134. Being so positioned, the control lever will be allowed to operate under very low lever effort in the recessed portions 122 and 124. This range of movement is specifically designed to coincide with a preselected range of implement manipulation which is sensed by the electronic control means 44 as it senses the rotation of pivot shaft 36 therewithin. When it is desired to move beyond the preselected range of implement manipulation, the control lever will be brought into contact with the first and fourth shoulders 126 and 132 that are aligned in the respective upper and lower recess portions 122 and 124. Upon contact with these shoulders, the lever effort required to move the control lever further in the first direction is increased substantially. This increase in lever effort serves as an indication to the operator that a second preselected condition is being approached and that further movement of the control lever and thus increased rotation of the pivot shaft 36 within the electronic control means 44, will bring about this condition. The second condition could be a detent position of a work implement for example. Likewise, movement of the control lever 12 in a second or rearward direction, as viewed in FIG. 2 will allow it to move with very low lever effort in the recess 120 until the cylindrical portion 30 is brought into contact with aligned second and third shoulders 128 and 130 respectively. Again, this serves as an indication to the operator that a second preselected condition will be initiated by the electronic control means 44 upon further movement of the control lever in the second direction. Upon release of the control lever, the second spring 140 will bring the control lever to a generally vertical orientation whereupon the cylindrical portion 30 will again become nested and maintained within the groove 112.

The movement of control lever 14 is essentially identical to that of control lever 12 with the exception that the positioning means 110 and the movement resisting means 118 are positioned in the first side portion 82 of the third bearing member 50 and that movement of the control lever 14 in either of the first or second directions will move the third bearing member toward the second bearing member 48 against the bias of the spring 134. Movement of the pivot shaft 43 will be sensed by electronic control means 45 to control a second implement between a first and second preselected condition as was described in conjunction with control lever 12.

It can be seen from the foregoing that the positioning of a control lever as well as the sensing of its movement between preselected operating condition has been integrally incorporated within the mounting components of the lever itself. In doing so, the complexity of the design and thus the number of components is substantially reduced. With such reduction substantial economic advantages are realized as well.

Other aspects, objects and advantages of this invention can be obtained from a study of the drawings, the disclosure and the appended claims.

I claim:

1. A control lever assembly and mounting apparatus, comprising:

a housing;

a control lever mounted within the housing for rotary movement with respect thereto about an axis defined by the housing, said rotary movement occurring upon application of a preselected force;

first and second bearing members, each bearing member having a first side portion and being positioned on opposite sides of the control lever from one another with the respective first side portions thereof in engagement with the control lever to allow limited movement of the control lever with respect to the housing;

means for positioning the control lever at a preselected position and resisting movement thereof, said positioning and movement resisting means being integrally defined by at least one of the first side portions defined by the first and second bearing members; and means for biasing the control level toward the preselected position having a first biasing member urging said one of the first side portions defined by the first and second bearing members into engagement with the control lever and a second biasing member urging the control lever for movement about the axis in absence of the preselected force.

2. The mounting apparatus as set forth in claim 1 wherein the housing defines a pair of mounting shafts that are positioned in spaced relationship to one another.

3. The mounting apparatus as set forth in claim 2 wherein the first bearing member further includes:

first and second end portions having respective first and second mounting bores defined therethrough, said mounting bores being sufficient for receiving said mounting shafts;

a generally centrally disposed bore extending through the first bearing member and being positioned between the first and second mounting bores; and a second side portion sufficient for engagement with the housing.

4. The mounting apparatus as set forth in claim 3 wherein the second bearing member further includes:

first and second end portions having respective first and second mounting bores defined therethrough, said mounting bores being sufficient for receiving said mounting shafts to mount the second bearing member on the mounting shafts for relative movement axially along said shafts;

a generally centrally disposed bore extending through the first bearing member and being positioned between the first and second mounting bores; and a second side portion.

5. The mounting apparatus as set forth in claim 4 wherein the first member of the biasing means includes a first spring member that is positioned between with the second side portion of the second bearing member and the housing to urge the second bearing member into engagement with the control lever.

6. The mounting apparatus as set forth in claim 4 wherein the control lever has a first generally cylindrical portion that extends from the housing, and a second portion that defines first and second pivot shafts, said pivot shafts being positioned to extend from opposite sides of the control lever along a generally horizontal axis, said first pivot shaft being positioned within the centrally disposed bore of the first bearing member and the second pivot shaft being positioned within the centrally disposed bore defined by the second bearing member, said control lever being pivotally mounted for movement about the horizontal axis in a first and second direction along a plane that is parallel to the first side portions of the bearing members.

7. The mounting apparatus as set forth in claim 6 wherein the second member of the biasing means further includes a second spring member that is positioned between the second end portion of the control lever and a lower portion of the housing to urge the control handle to a position that is substantially vertical.

8. The mounting apparatus as set forth in claim 6 wherein the positioning means further includes an arcuate groove defined in the first side portion of the second bearing member along a generally vertical axis, said groove being sufficient for nesting engagement with the generally cylindrical portion of the control lever to position the control handle along said vertical axis.

9. The mounting apparatus as set forth in claim 8 wherein the movement resisting means includes a recessed portion formed in the first side of the second bearing member to define a pair of shoulders that are positioned at an angle with respect to the groove, said shoulders extending between the centrally disposed bore and at least one of an upper and a lower surface of the second bearing member and being positioned to contact the control lever as it travels in either of its first and second directions.

10. A control lever assembly and mounting apparatus, comprising:

a housing;

a first control lever having a first, generally cylindrical end portion and first and second pivot shafts that extend from opposing sides of the control lever along a substantially horizontal axis, said control lever being positioned with the first end portion extending from the housing for movement with respect to said housing in a first and a second direction;

a second control lever having a first generally cylindrical end portion and first and second pivot shafts that extend from opposing sides of the second control lever along an axis that is common with the axis defined by the first control lever, said second control lever being positioned with the first end portion extending from the housing for movement with respect to said housing in a first and a second direction;

a first bearing member having first and second side portions and a generally centrally disposed bore extending therethrough, said first bearing member being positioned with the first side portion engaged with the first control lever and the second side portion engaged with the housing and the first pivot shaft of the control lever positioned within the centrally disposed bore;

a second bearing member having first and second side portions and a generally centrally disposed bore extending therethrough, said second bearing member being positioned with the first side portion engaged with the first control lever and the second pivot shaft of the first control lever positioned within the centrally disposed bore;

a third bearing member having first and second side portions and a generally centrally disposed bore extending therethrough, said third bearing member being positioned with the first side portion engaged with the second control lever and the first pivot shaft of the second control lever positioned within the centrally disposed bore;

a fourth bearing member having first and second side portions and a generally centrally disposed bore extending therethrough, said fourth bearing member being positioned with the first side portion engaged with the control lever and the second side portion engaged with the housing and the second pivot shaft of the second control lever positioned within the centrally disposed bore;

means for positioning the respective control levers at a preselected position, said positioning means being integrally defined by at least one of the first side portions defined by the bearing members engaged with the respective control levers; and means for resisting movement of the respective control levers, said movement resisting means being integrally defined by at least one of the first side portions defined by the bearing members engaged with the respective control levers.

11. The mounting apparatus as set forth in claim 10 wherein the housing includes a pair of mounting shafts that are fixed to the housing in spaced parallel relationship to one another.

12. The mounting apparatus as set forth in claim 11 wherein each bearing member defines a first end portion having a bore extending therethrough and a second end portion having a bore extending therethrough, said bores being sufficient for receiving the respective mounting shafts to mount the bearing members thereto.

13. The mounting apparatus as set forth in claim 12 wherein the second and third bearing members are slidably mounted on the mounting shafts for movement toward and away from the respective control levers.

14. The mounting apparatus as set forth in claim 13 wherein a first spring member is positioned about the second pivot shaft of the first control lever and the first pivot shaft of the second control lever and has a first end portion engaged with the second side portion of the second bearing member and a second end portion engaged with the second side portion of the third bearing member to urge the respective bearing members away from each other and into engagement with the respective control levers.

15. The mounting apparatus as set forth in claim 10 wherein the movement resisting means for the respective control levers includes:

a first recessed portion defined in each of the first side portions of the second and third bearing members, said recessed portions defining a first and a second shoulder that extends from the centrally disposed bore to an upper surface of the respective bearing member, said shoulders being positioned at an angle with respect to one another; and a second recessed portion defined in each of the first side portions of the second and third bearing members, said recessed portions defining a third and a fourth shoulder that extends from the centrally disposed bore to a lower surface of the respective bearing member, said shoulders being positioned at an angle with respect to one another.

16. The mounting apparatus as set forth in claim 15 wherein the control lever is movable in response to a first preselected force in a first direction to a first position wherein it will engage the first and fourth shoulders on opposite sides of the control lever and is movable in said first direction beyond said first position in response to a force that is greater than that of the first preselected force.

17. The mounting apparatus as set forth in claim 10 wherein the positioning means for the respective control levers includes an arcuate groove defined in the respective first side portions of the second and third bearing members along a generally vertical axis, said groove being sufficient for nesting engagement with the cylindrical portion of the respective control levers.

18. The mounting apparatus as set forth in claim 17 wherein a second spring member is positioned between the second end portion of the respective control levers and the housing to urge the control levers to a generally vertical position and into nesting engagement with the respective grooves defined in the second and third bearing members.

* * * * *